US009740140B2

(12) United States Patent
Ishii

(10) Patent No.: US 9,740,140 B2
(45) Date of Patent: Aug. 22, 2017

(54) DEVELOPER STIRRING MEMBER AND IMAGE FORMING APPARATUS

(71) Applicant: KYOCERA Document Solutions Inc., Osaka-shi, Osaka (JP)

(72) Inventor: Akira Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/098,235

(22) Filed: Apr. 13, 2016

(65) Prior Publication Data

US 2016/0306295 A1 Oct. 20, 2016

(30) Foreign Application Priority Data

Apr. 16, 2015 (JP) ..... 2015-084499

(51) Int. Cl.
*G03G 15/08* (2006.01)

(52) U.S. Cl.
CPC ... *G03G 15/0889* (2013.01); *G03G 2215/085* (2013.01)

(58) Field of Classification Search
CPC ..... G03G 15/0889; G03G 15/0865; G03G 15/0877; G03G 15/0808; G03G 2215/085; G03G 2215/0822
See application file for complete search history.

(56) References Cited

U.S. PATENT DOCUMENTS 6,337,964 B2 * 1/2002 Inami ..... 399/254
2011/0293332 A1 * 12/2011 Kawakami ..... G03G 15/0822 399/254
2014/0029984 A1 * 1/2014 Fujii ..... G03G 15/0865 399/258

FOREIGN PATENT DOCUMENTS

JP 2013246268 A 12/2013

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

A developer stirring member is supported by a rotation portion in a container that stores developer and is configured to stir the developer. The developer stirring member includes a base portion and a reinforcement portion. The base portion is a film-like member including a first supported portion and an end portion, the first supported portion being supported by the rotation portion, the end portion being a free end to pivot. The reinforcement portion is a film-like member overlapping only a part of the base portion that is on a first supported portion side.

6 Claims, 4 Drawing Sheets

DEVELOPER STIRRING MEMBER AND IMAGE FORMING APPARATUS

INCORPORATION BY REFERENCE

This application is based upon and claims the benefit of priority from the corresponding Japanese Patent Application No. 2015-084499 filed on Apr. 16, 2015, the entire contents of which are incorporated herein by reference.

BACKGROUND

The present disclosure relates to a developer stirring member an image forming apparatus.

An electrophotographic image forming apparatus includes an image forming portion that includes an image carrying member, a charging portion, a developing portion, and a transfer portion. Furthermore, the image forming apparatus includes a developer supply portion that supplies developer to the developing portion.

The developer supply portion includes a container for storing the developer, a developer stirring member provided in the container, and a developer feed portion. The developer stirring member stirs the developer in the container. The developer feed portion feeds the developer from the container to the developing portion.

The developer stirring member may be a film-like member that is supported by a rotation portion in the container and is rotated to stir the developer. In that case, the developer stirring member throws the developer from below up to the developer feed portion by its elastic force while rotating. In addition, there is known a configuration where two rotatable sheet bodies are provided in the container.

SUMMARY

A developer stirring member according to an aspect of the present disclosure is supported by a rotation portion in a container that stores developer and is configured to stir the developer. The developer stirring member includes a base portion and a reinforcement portion. The base portion is a film-like member including a first supported portion and an end portion, the first supported portion being supported by the rotation portion, the end portion being a free end to pivot. The reinforcement portion is a film-like member overlapping only a part of the base portion that is on a first supported portion side.

An image forming apparatus according to another aspect of the present disclosure includes a developing portion, a container, a rotation portion, the developer stirring member according to the aspect of the present disclosure, and a developer feed portion. The developing portion develops, by developer, an electrostatic latent image formed on an image carrying member. The container stores the developer to be supplied. The rotation portion is rotatably supported in the container. The developer stirring member is supported by the rotation portion. The developer feed portion is configured to feed the developer from the container to the developing portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the attached drawings. It should be noted that the following embodiments are examples of specific embodiments of the present disclosure and should not limit the technical scope of the present disclosure.

Configuration of Image Forming Apparatus 10

Figure 1:
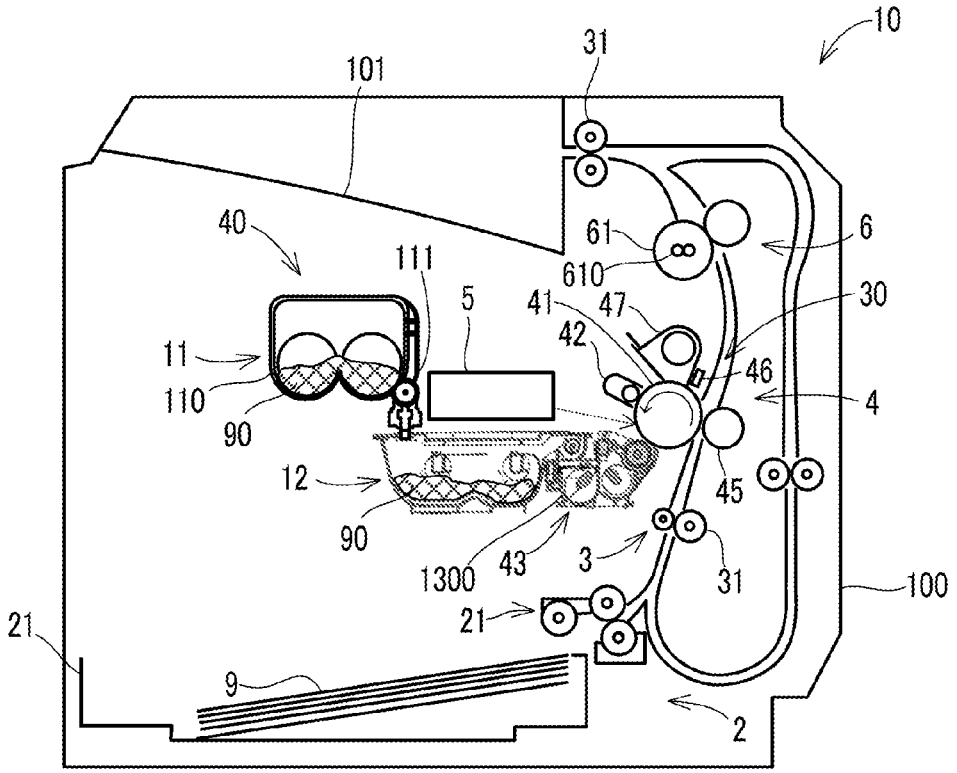
FIG. 1 is a configuration diagram of an image forming apparatus according to embodiments.
Figure 2:
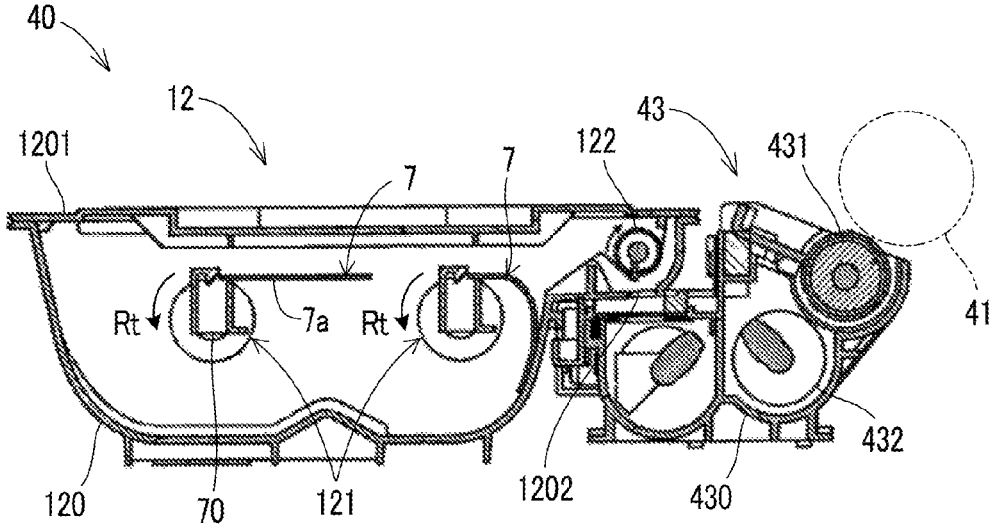
FIG. 2 is a configuration diagram of a second-stage developer supply portion and a developing portion included in the image forming apparatus according to embodiments.
Figure 3:
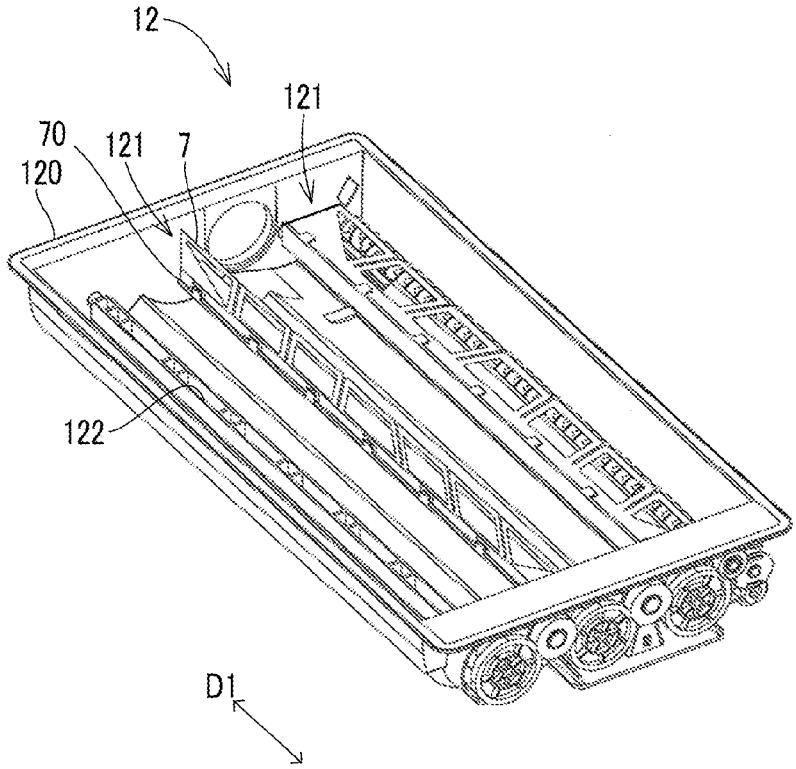
FIG. 3 is a perspective view of the inside of the second-stage developer supply portion.

First, a description is given of a configuration of an image forming apparatus 10 according to the embodiments with reference to FIG. 1 to FIG. 3. The image forming apparatus 10 is an electrophotographic image forming apparatus.

As shown in FIG. 1, the image forming apparatus 10 includes, in a housing 100, a sheet supply portion 2, a sheet conveying portion 3, an image forming portion 4, a laser scanning portion 5, a fixing portion 6, and a developer supply portion 40.

It is noted that the image forming apparatus 10 may be a multifunction peripheral having a plurality of functions among functions of a printer, a copier, a facsimile and the like.

The sheet supply portion 2 includes a sheet receiving portion 21 and a sheet feed portion 22. The sheet receiving portion 21 is configured to store a plurality of recording sheets 9 stacked therein. It is noted that the recording sheet 9 is a sheet-like image formation medium such as a sheet of paper, a sheet of coated paper, a postcard, an envelope, or an OHP sheet.

The sheet feed portion 22 is configured to feed a recording sheet 9 from the sheet receiving portion 21 to a conveyance path 30, by rotating while in contact with the recording sheet 9.

The sheet conveying portion 3 conveys the recording sheet 9 supplied from the sheet supply portion 2 to the image forming portion 4. Furthermore, a conveyance roller 31 discharges the recording sheet 9 after image formation, onto a discharge tray 101 from a discharge port of the conveyance path 30.

The electrophotographic image forming portion 4 forms an image of developer 90 on a surface of the recording sheet 9 that is moving in the conveyance path 30 after being fed from the sheet feed portion 22. The developer 90 contains toner.

The image forming portion 4 includes a drum-like photoconductor 41, a charging portion 42, a developing portion 43, a transfer portion 45, an electricity removing portion 46, and a cleaning portion 47. It is noted that the photoconductor 41 is an example of the image carrying member.

The photoconductor 41 rotates, and the charging portion 42 uniformly charges the surface of the photoconductor 41. Furthermore, the laser scanning portion 5 writes an electrostatic latent image on the surface of the charged photoconductor 41 by scanning a laser beam thereon.

In addition, the developing portion 43 supplies the developer 90 to the photoconductor 41 such that the electrostatic latent image is developed by the developer 90. Furthermore, the transfer device 45 transfers the image (image of the developer 90) on the surface of the photoconductor 41, to the recording sheet 9 that is moving in the conveyance path 30.

As shown in FIG. 2, the developing portion 43 includes a developing tank 430, a developing roller 431, and a circulative conveying portion 432. The developing tank 430 is a container for temporarily storing the developer 90 supplied from the developer supply portion 40.

In the developing portion 43, the circulative conveying portion 432 circulatively conveys the developer 90 in the developing tank 430, and the developing roller 431 carries the developer 90 in the developing tank 430 and supplies the developer 90 to the photoconductor 41.

In addition, the electricity removing portion 46 removes electricity from the surface of the photoconductor 41 after the image transfer. Furthermore, the cleaning portion 47 removes the residual developer 90 from the surface of the photoconductor 41.

The fixing device 6 causes a recording sheet 9 with an image formed thereon to be nipped between a pressure roller 62 and a fixing roller 61 that includes a heater 610, and sends the recording sheet 9 to a downstream process. This allows the fixing device 6 to heat the image of the developer 90 on the recording sheet 9 and fix the image to the recording sheet 9.

The developer supply portion 40 includes a first-stage developer supply portion 11 and a second-stage developer supply portion 12. The first-stage developer supply portion 11 is attached to a housing 100 (the main body) of the image forming apparatus 10 in a detachable manner. The second-stage developer supply portion 12 is called an intermediate hopper or the like.

The first-stage developer supply portion 11 includes a first-stage container 110 and a first-stage feed portion 111. The first-stage container 110 is a container for storing the developer 90. The first-stage feed portion 111 rotates and thereby feeds the developer 90 from the inside of the first-stage container 110 to the second-stage developer supply portion 12.

The second-stage developer supply portion 12 feeds the developer 90 supplied from the first-stage developer supply portion 11, to the developing tank 430 of the developing portion 43 while stirring the developer 90. As shown in FIG. 2 and FIG. 3, the second-stage developer supply portion 12 includes a second-stage container 120, a stirring mechanism 121, and a second-stage feed portion 122.

The second-stage container 120 is a container for storing the developer 90 supplied from the first-stage developer supply portion 11. The second-stage feed portion 122 feeds the developer 90 in the second-stage container 120 to the developing tank 430 of the developing portion 43. The second-stage feed portion 122 is, for example, a screw conveyor.

The second-stage container 120 has an inlet 1201 and an outlet 1202 which are each an opening. The outlet 1202 is formed below the second-stage feed portion 122 in the second-stage container 120. The outlet 1202 communicates with the developing tank 430.

The stirring mechanism 121 includes a rotation portion 70 and a developer stirring member 7. The rotation portion 70 is rotatably supported in the second-stage container. The second-stage feed portion 122 and the rotation portion 70 are rotationally driven by a drive mechanism (not shown) that includes a motor and a gear mechanism.

The developer stirring member 7 is supported by the rotation portion 70 in the second-stage container 120 storing the developer 90. As the rotation portion 70 rotates, the developer stirring member 7 rotates around the rotation portion 70. In the following description, the rotation direction of the rotation portion 70, namely, the rotation direction of the developer stirring member 7 is referred to as a forward rotation direction Rt.

The developer stirring member 7 is formed by molding a synthetic resin such as PET (polyethylene terephthalate) into a film-like shape. As a result, the developer stirring member 7 is flexible. It is noted that the developer stirring member 7 may be formed by molding another synthetic resin such as vinyl chloride or polycarbonate into a film-like shape.

The developer stirring member 7 rotates and thereby stirs the developer 90 in the second-stage container 120. Furthermore, the developer stirring member 7 also plays a role of throwing the developer 90 from below up to the second-stage feed portion 122 by its elastic force while rotating.

Meanwhile, when a large amount of developer 90 is stored in the second-stage container 120, the elastic force of the film-like developer stirring member would be insufficient with respect to the weight of the developer 90. In that case, the stirring and throwing-up of the developer 90 by the developer stirring member would be insufficient.

In addition, when a thick film-like member is adopted as the developer stirring member, the developer stirring member does not flex sufficiently if a small amount of developer 90 is stored in the second-stage container 120. In this case, too, the elastic force of the developer stirring member becomes insufficient, and the developer 90 is not thrown up sufficiently. It is noted that this also applies to a case where, for example, two film-like members of the same size are adopted as the developer stirring member.

On the other hand, the developer stirring member 7 of the present embodiments, due to its configuration described below, has high adaptability to variations of the storage amount of the developer 90 in the second-stage container 120. That is, the developer stirring member 7 can throw the developer 90 up to the second-stage feed portion 122 by an appropriate elastic force regardless of the storage amount of the developer 90 in the second-stage container 120 while stirring the developer 90 in the second-stage container 120.

First Embodiment

Figure 4:
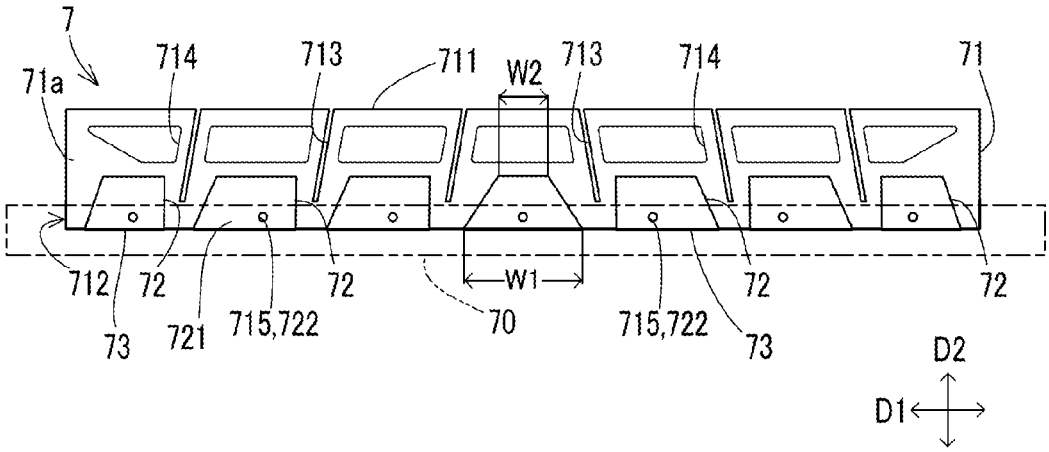
FIG. 4 is a plan view of a developer stirring member according to a first embodiment.
Figure 5:
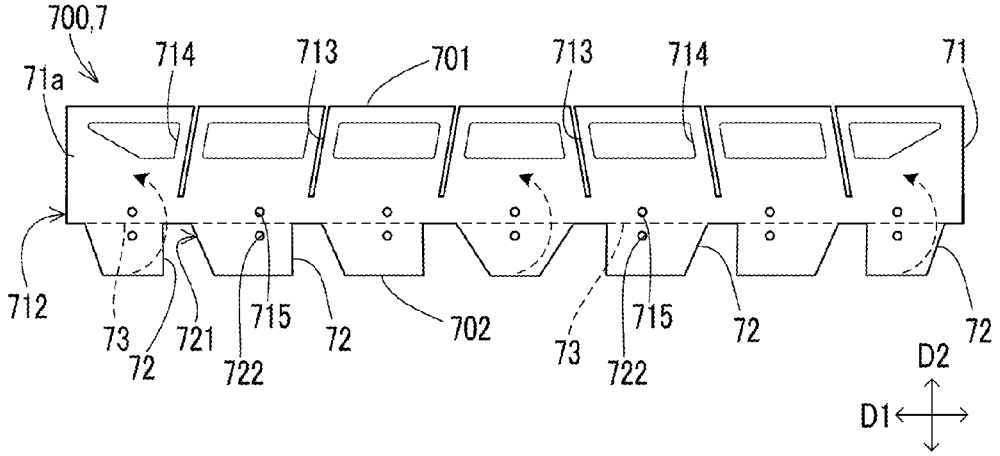
FIG. 5 is a plan view of an original member of the developer stirring member according to the first embodiment.

The following describes the developer stirring member 7 of the first embodiment with reference to FIG. 4 and FIG. 5.

The developer stirring member 7 includes a base portion 71 and a reinforcement portion 72.

The base portion 71 is a film-like member including a first supported portion 712 and an end portion 711. The first supported portion 712 is supported by the rotation portion 70. The end portion 711 is a free end configured to pivot when the developer stirring member 7 rotates.

In the following description, the longitudinal direction of the first supported portion 712 is referred to as a first direction D1. The first direction D1 extends along a center line around which the developer stirring member 7 rotates, and is the longitudinal direction of the rotation portion 70. In addition, a direction in which the first supported portion 712 and the end portion 711 face each other is referred to as a second direction D2. Furthermore, a surface of the base portion 71 that is on the rear side in the forward rotation direction Rt is referred to as a rear surface 71*a*.

In the present embodiment, the base portion 71 has a plurality of slits 713 that extend from the end portion 711 toward the first supported portion 712. In the example shown in FIG. 4, the slits 713 are formed oblique to the second direction D2.

Furthermore, in the example shown in FIG. 4, the base portion 71 has a plurality of holes 714. The plurality of holes 714 are aligned in the first direction D1. The plurality of holes 714 are respectively formed in a plurality of regions into which the base portion 71 is divided by the slits 713.

The holes 714 are formed in order to relieve the pressure that the base portion 71 receives from the developer 90 at different positions in the first direction D1. In addition, the slits 713 are formed so that portions of the base portion 71 at different positions in the first direction D1 can flex appropriately by the pressure received from the developer 90.

The reinforcement portion 72 is a film-like member that overlaps only a part of the base portion 71 on the first supported portion 712 side. In the present embodiment, the reinforcement portion 72 overlaps only the rear surface 71*a* of the base portion 71.

The reinforcement portion 72 includes a second supported portion 721 that overlaps the first supported portion 712 of the base portion 71. As a result, the reinforcement portion 72 overlaps only a part of the rear surface 71*a* of the base portion 71 that includes a part or all of the first supported portion 712. The second supported portion 721 is supported by the rotation portion 70, together with the first supported portion 712 of the base portion 71.

In the example shown in FIG. 4, the developer stirring member 7 includes a plurality of reinforcement portions 72 aligned in the first direction D1.

In each of the plurality of reinforcement portions 72, a part thereof on the side of the first supported portion 712 of the base portion 71 is larger in width in the first direction D1 than a part thereof on the side of the end portion 711 of the base portion 71. That is, in each of the plurality of reinforcement portions 72, a first width W1 of the portion on the side of the first supported portion 712 of the base portion 71 is larger than a second width W2 of the portion on the side of the end portion 711.

The developer stirring member 7 is obtained by folding a part of an original member 700 shown in FIG. 5. The original member 700 is a film-like member. That is, a folded part of the original member 700 is the reinforcement portions 72, and the remaining part of the original member 700 is the base portion 71.

In the examples shown in FIG. 4 and FIG. 5, the base portion 71 extends from a first edge portion 701 of the original member 700 to a fold line 73 that is positioned between the first edge portion 701 and a second edge portion 702 that is opposite to the first edge portion 701. It is noted that the first edge portion 701 and the second edge portion 702 are opposite to each other in a direction perpendicular to the longitudinal direction of the original member 700.

On the other hand, the reinforcement portions 72 extend from the fold line 73 to the second edge portion 702 of the original member 700. As a result, the first supported portion 712 of the base portion 71 corresponds to a portion of the original member 700 that is adjacent to the fold line 73. In addition, the end portion 711 of the base portion 71 corresponds to the first edge portion 701 of the original member 700.

In other words, the reinforcement portions 72 is formed by folding the part of the original member 700 including the second edge portion 702 toward the first edge portion 701.

The first supported portion 712 of the base portion 71 has attachment holes 715, and the second supported portions 721 of the reinforcement portions 72 has attachment holes 722, wherein the attachment holes 715 and the attachment holes 722 are formed to overlap each other.

Figure 6:
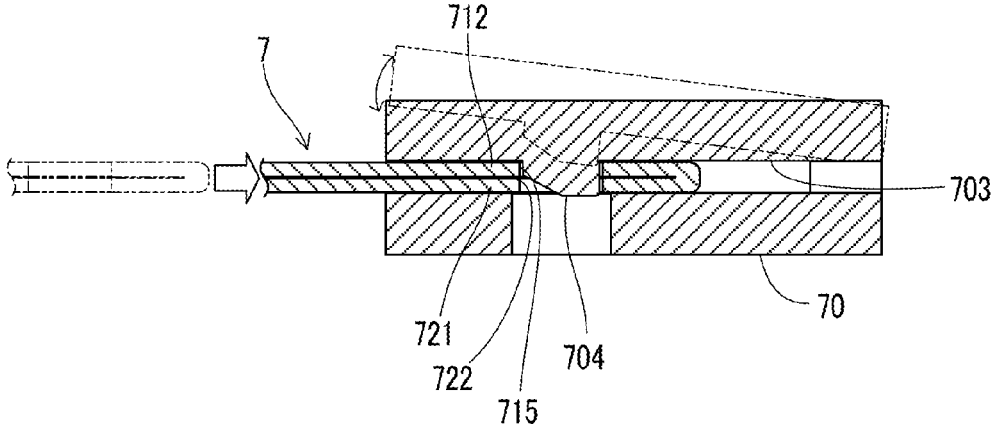
FIG. 6 is a cross section of the developer stirring member showing the support configuration thereof.

FIG. 6 is a cross section of the developer stirring member 7 showing the support configuration thereof. The rotation portion 70 has a gap in which the first supported portion 712 and the second supported portion 721 can be inserted. Furthermore, a projection portion 704 is formed in the gap 703 of the rotation portion 70.

The rotation portion 70 is elastically deformed in a direction in which the gap 703 is expanded when the first supported portion 712 and the second supported portion 721 overlapping each other are inserted in the gap 703. Furthermore, in the state where the first supported portion 712 and the second supported portion 721 are inserted in the gap 703, the projection portion 704 of the rotation portion 70 passes through the attachment holes 715 and 722. This allows the first supported portion 712 and the second supported portion 721 of the developer stirring member 7 to be held by the rotation portion 70.

FIG. 5 shows an example in which the attachment holes 715 and 722 are formed in the original member 700. However, the attachment holes 715 and 722 may be formed so as to pass through the first supported portion 712 and the second supported portion 721 that overlap each other after a part of the original member 700 is folded.

In the developer stirring member 7, the reinforcement portions 72 overlap only a partial area of the base portion 71 on the first supported portion 712 side. In that case, a part of the base portion 71 including the end portion 711 is easier to flex than the partial area that overlaps the reinforcement portions 72. As a result, even when a small amount of developer 90 is stored in the second-stage container 120, a part of the developer stirring member 7 on the end portion 711 side flexes sufficiently. The flexing of the developer stirring member 7 provides a sufficient elastic force that is necessary to throw up the developer 90.

In addition, when a large amount of developer 90 is stored in the second-stage container 120, the reinforcement portions 72 prevent the developer stirring member 7 from being excessively deformed by the weight of the developer 90. Furthermore, the reinforcement portions 72 and the part of the base portion 71 overlapping the reinforcement portions 72 flex appropriately due to the weight of the developer 90. This provides an elastic force that is required to throw up the developer 90.

As a result, the developer stirring member 7 has high adaptability to variations of the storage amount of the developer 90 in the second-stage container 120.

In addition, the reinforcement portions 72 of the present embodiment includes the second supported portion 721 supported by the rotation portion 70, and overlaps the rear surface 71*a* of the base portion 71. As a result, even when the reinforcement portion 72 is not adhered to the base portion 71, an effect of reinforcing the base portion 71 that rotates in the forward rotation direction Rt is obtained.

Since there is no need to adhere the reinforcement portion 72 to the base portion 71, it is easy to manufacture the developer stirring member 7. It is noted that the reinforcement portion 72 may be adhered to a surface of the base portion 71 that is on the front side in the forward rotation direction Rt.

In the present embodiment, the reinforcement portion 72 and the base portion 71 are a folded part and the remaining part of the original member 700 that is a sheet of film-like member, respectively. This enables the developer stirring member 7 to be realized without increasing the number of parts.

Furthermore, the reinforcement portions 72 extend from the fold line 73 to the second edge portion 702 of the original member 700, and the first supported portion 712 and the end portion 711 of the base portion 71 correspond to a portion of the original member 700 that is adjacent to the fold line 73 and the first edge portion 701 of the original member 700, respectively. This provides high degree of freedom in design of the reinforcement portion 72.

In the second-stage container 120, the larger the amount of the developer 90 is, the larger the stress applied to the portion of the base portion 71 on the first supported portion 712 side is. On the other hand, in each reinforcement portion 72, a portion on the side of the first supported portion 712 of the base portion 71 is larger in width in the first direction D1 than a portion on the side of the end portion 711 of the base portion 71.

As a result, in the developer stirring member 7, in the area in which the base portion 71 and the reinforcement portion 72 overlap each other, the part on the end portion 711 side is relatively easy to flex, and the part on the first supported portion 712 side has relatively high rigidity. This further increases the adaptability of the second-stage container 120 to variations of the storage amount of the developer 90 in the second-stage container 120.

Second Embodiment

Figure 7:
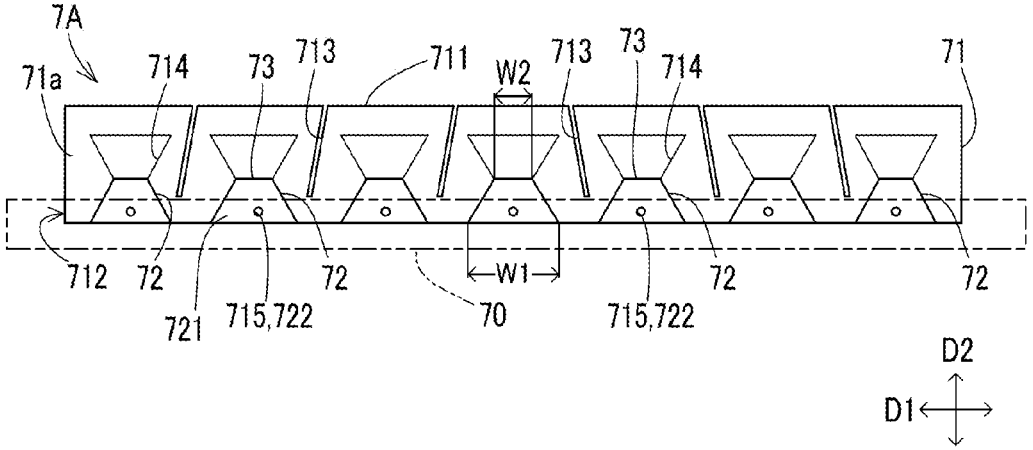
FIG. 7 is a plan view of a developer stirring member according to a second embodiment.
Figure 8:
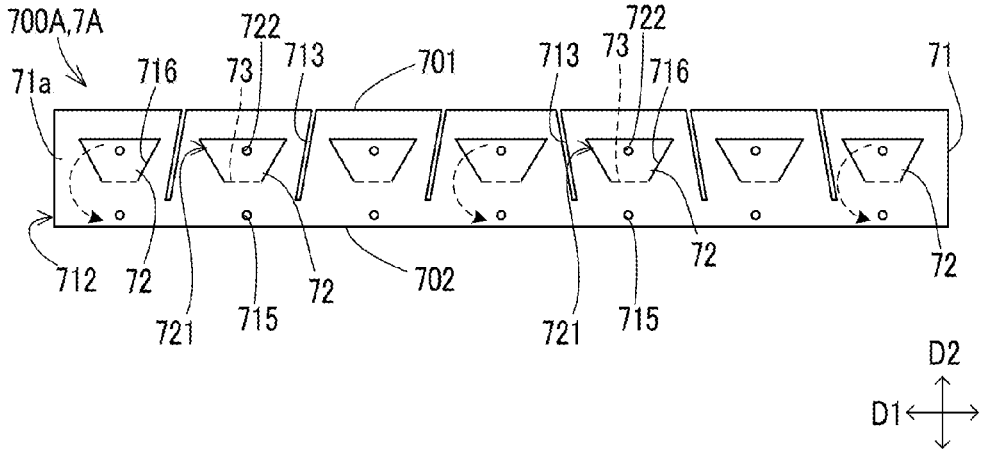
FIG. 8 is a plan view of an original member of the developer stirring member according to the second embodiment.

The following describes a developer stirring member 7A of the second embodiment with reference to FIG. 7 and FIG. 8. As is the case with the developer stirring member 7, the developer stirring member 7A is also applied to the second-stage developer supply portion 12 of the image forming apparatus 10.

The developer stirring member 7A differs from the developer stirring member 7 only in the configuration for folding up the reinforcement portions 72.

FIG. 7 is a plan view of the developer stirring member 7A. FIG. 8 is a plan view of an original member 700A of the developer stirring member 7A. In FIG. 7 and FIG. 8, the same components as those shown in FIG. 1 to FIG. 6 are assigned the same reference signs. In the following, the difference of the developer stirring member 7A from the developer stirring member 7 is described.

In the developer stirring member 7A, too, the reinforcement portion 72 and the base portion 71 are a folded part and the remaining part of an original member 700A that is a sheet of film-like member, respectively.

In the present embodiment, the end portion 711 and the first supported portion 712 of the base portion 71 correspond to the first edge portion 701 and the second edge portion 702 of the original member 700A, respectively, the first edge portion 701 and the second edge portion 702 being opposite to each other.

The reinforcement portions 72 of the developer stirring member 7A are formed by cutting and bending up a plurality of parts of an original member 700A on the first edge portion 701 side and folding the parts to the second edge portion 702 side of the original member 700A. That is, the original member 700A has a sequence of cut lines 716 which divide the portions to be the reinforcement portions 72 from the portion to be the base portion 71. The cut lines 716 are formed to surround each portion to be the reinforcement portions 72 over the whole portion that is to be the fold line 73 from an end to the other end thereof.

In the developer stirring member 7A, too, a part of the reinforcement portions 72 folded at the fold line 73 becomes the second supported portion 721 that overlaps the first supported portion 712 of the base portion 71. Furthermore, in each of the reinforcement portions 72 of the developer stirring member 7A, the first width W1 of the portion on the side of the first supported portion 712 of the base portion 71 is larger than the second width W2 of the portion on the side of the end portion 711.

When the developer stirring member 7A is adopted, the same effect is obtained as when the developer stirring member 7 is adopted. Furthermore, in the developer stirring member 7A, after the reinforcement portions 72 are cut and bent up, the holes made thereby in the base portion 71 become the holes 714. As a result, no waste is generated when the original member 700A is formed into the developer stirring member 7A. This increases the use efficiency of the material.

Third Embodiment

Next, a developer stirring member 7B of the third embodiment is described with reference to FIG. 9. As is the case with the developer stirring members 7 and 7A, the developer stirring member 7B is also applied to the second-stage developer supply portion 12 of the image forming apparatus 10.

The developer stirring member 7B differs from the developer stirring member 7 only in the configuration for folding up the reinforcement portion 72.

Figure 9:
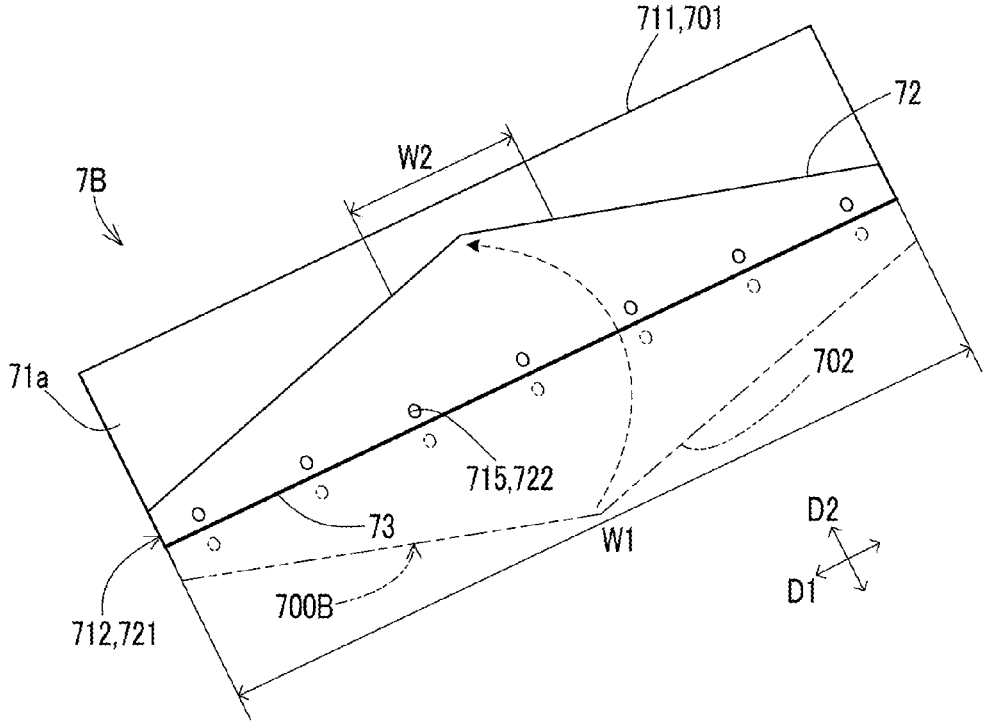
FIG. 9 is a plan view of a developer stirring member according to a third embodiment.

FIG. 9 is a plan view of the developer stirring member 7B. In FIG. 9, the same components as those shown in FIG. 1 to FIG. 8 are assigned the same reference signs. In the following, the difference of the developer stirring member 7B from the developer stirring member 7 is described.

In the developer stirring member 7B, too, a folded part of an original member 700B and the remaining part thereof correspond to the reinforcement portion 72 and the base portion 71 respectively, wherein the original member 700B is a film-like member. It is noted that in FIG. 9, the original member 700B is represented by an imaginary line (two-dot chain line).

In the developer stirring member 7B, as is the case with the developer stirring member 7, the base portion 71 extends from the first edge portion 701 of the original member 700B to the fold line 73, and the reinforcement portion 72 extends from the fold line 73 to the second edge portion 702 of the original member 700B.

It is noted here that the developer stirring member 7B includes one reinforcement portion 72 that extends in the first direction D1. In addition, the base portion 71 of the developer stirring member 7B does not have the slits 713 and the holes 714. There are the points in which the developer stirring member 7B differs from the developer stirring member 7.

When the developer stirring member 7B is adopted, the same effect is obtained as when the developer stirring member 7 is adopted.

Application Examples

In the above-described developer stirring members 7, 7A and 7B, the base portion 71 and the reinforcement portion 72 may be individual sheet members. In addition, in the developer stirring member 7B, the base portion 71 may have either one or both of the slits 713 and the holes 714.

It is noted that the developer stirring member and the image forming apparatus of the present disclosure may be configured by, within the scope of claims, freely combining the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developer stirring mechanism comprising:

a rotation portion rotatably supported in a container that stores developer; and a developer stirring member supported by the rotation portion and configured to stir the developer, the developer stirring member comprising:

a base portion including a first supported portion and an end portion, the first supported portion being supported by the rotation portion, the end portion being a free end to pivot, and the base portion having a plurality of slits that extend from the end portion toward the first supported portion; and a plurality of reinforcement portions overlapping a surface of the base portion that is on a rear portion side in a rotation direction, each of the plurality of reinforcement portions including a second supported portion that is held by the rotation portion in a state of overlapping the first supported portion, the plurality of reinforcement portions aligned in a longitudinal direction of the first supported portion, and the plurality of reinforcement portions respectively overlapping a plurality of regions into which the base portion is divided by the plurality of slits, wherein the plurality of reinforcement portions and the base portion are a folded part and a remaining part, respectively, of an original member that is a sheet of film-like member, the sheet of film-like member being elastic and formed from a synthetic resin.

2. The developer stirring mechanism according to claim 1, wherein the base portion extends from a first edge portion of the original member to a fold line that is positioned between the first edge portion and a second edge portion that is opposite to the first edge portion, the plurality of reinforcement portions extend from the fold line to the second edge portion of the original member, and the first supported portion of the base portion corresponds to a portion of the original member that is adjacent to the fold line, and the end portion of the base portion corresponds to the first edge portion of the original member.

3. The developer stirring mechanism according to claim 1, wherein the end portion of the base portion corresponds to a first edge portion of the original member, and the first supported portion of the base portion corresponds to a second edge portion of the original member, the second edge portion being opposite to the first edge portion, and the plurality of reinforcement portions are formed by cutting and bending up a part of the original member on a first edge portion side and folding the part to a second edge portion side of the original member.

4. The developer stirring mechanism according to claim 1, wherein each of the plurality of reinforcement portions is formed in a trapezoidal shape whose width gradually narrows from a side of the first supported portion of the base portion to a side of the end portion of the base portion.

5. The developer stirring mechanism according to claim 1, wherein the first supported portion has attachment holes and the second supported portions have attachment holes such that the attachment holes of the first supported portion and the attachment holes of the second supported portions overlap each other;

the rotation portion has a gap in which the first supported portion and the second supported portions are inserted in a state of overlapping each other;

projection portions are formed in the gap of the rotation portion; and in a state where the first supported portion and the second supported portions are inserted in the gap, the projection portions pass through the attachment holes of the first supported portion and the attachment holes of the second supported portions.

6. An image forming apparatus comprising:

a developing portion configured to develop, by developer, an electrostatic latent image formed on an image carrying member;

a container storing the developer to be supplied;

a rotation portion rotatably supported in the container;

the developer stirring mechanism according to claim 1 provided in the container; and a developer feed portion configured to feed the developer from the container to the developing portion.

* * * * *